US010398179B2

(12) United States Patent
Qiu

(10) Patent No.: US 10,398,179 B2
(45) Date of Patent: Sep. 3, 2019

(54) ATOMIZER AND E-CIGARETTE THEREOF

(71) Applicant: CHANGZHOU PATENT ELECTRONIC TECHNOLOGY CO., LTD., Changzhou (CN)

(72) Inventor: Weihua Qiu, Changzhou (CN)

(73) Assignee: CHANGZHOU PATENT ELECTRONIC TECHNOLOGY CO., LTD., Jiangsu (CN)

( * ) Notice: Subject to any disclaimer, the term of this patent is extended or adjusted under 35 U.S.C. 154(b) by 155 days.

(21) Appl. No.: 15/818,334

(22) Filed: Nov. 20, 2017

(65) Prior Publication Data

US 2018/0140017 A1 May 24, 2018

(30) Foreign Application Priority Data

Nov. 21, 2016 (CN) ..... 2016 2 124121 U
Dec. 20, 2016 (CN) ..... 2016 1 1182499

(51) Int. Cl.

| | |
|---|---|
| ***A24F 13/00*** | (2006.01) |
| ***A24F 47/00*** | (2006.01) |
| ***H05B 3/44*** | (2006.01) |
| ***H05B 3/03*** | (2006.01) |

(52) U.S. Cl.
CPC ..... *A24F 47/008* (2013.01); *H05B 3/03* (2013.01); *H05B 3/44* (2013.01)

(58) Field of Classification Search
CPC ..... A24F 47/00
USPC ..... 131/328, 329
See application file for complete search history.

(56) References Cited

U.S. PATENT DOCUMENTS

2015/0245659 A1* 9/2015 DePiano ..... A24F 47/008 392/397
2015/0335071 A1* 11/2015 Brinkley ..... F22B 1/284 131/328

* cited by examiner

*Primary Examiner* — Phuong K Dinh
(74) *Attorney, Agent, or Firm* — J.C. Patents

(57) ABSTRACT

The present invention discloses an atomizer and an E-cigarette thereof, which use a holding portion movably provided on a terminal to achieve securing of a heating element, such that a user uses only hands for operation but without the help of an additional mounting tool. The present invention also discloses an atomizer and an E-cigarette thereof, which can adjust a dimension of a bore for mounting a heating wire by fitting a securing head with a sleeving, and thus various heating wires having different diameters can be mounted, such that the heating wires can be quickly and conveniently mounted, thereby achieving easy operation and good user experience.

20 Claims, 23 Drawing Sheets

ATOMIZER AND E-CIGARETTE THEREOF

CROSS REFERENCE TO RELATED APPLICATIONS

This application claims priority to Chinese Patent Application No. 201611182499.8, filed on Dec. 20, 2016, entitled "Atomizer and E-cigarette thereof", and Chinese Patent Application No. 201621241215.3, filed on Nov. 21, 2016, entitled "Atomizer and E-cigarette thereof", which are incorporated herein by reference in their entireties.

TECHNICAL FIELD

The present invention relates to the technical field of E-cigarettes and, in particular, to an atomizer and an E-cigarette thereof.

BACKGROUND

An existing E-cigarette includes an atomizer and a battery, where the atomizer is provided with a liquid storage assembly and a heating assembly. The heating assembly is electrically driven by the battery to heat cigarette liquid in the liquid storage assembly in order to form smoke for use by a user.

The heating assembly of the existing atomizer includes a heating wire and a liquid guiding element, and the heating wire is generally wound around the liquid guiding element to heat the cigarette liquid adsorbed by the liquid guiding element, thereby producing smoke. On both positive and negative posts of the existing atomizer, there are opened with screw holes. Both ends of the heating wire are screw secured to the positive and negative posts by the user through the screw holes. Generally, the heating wire is screw secured by the user himself/herself with the help of an additional tool, which leads to a troublesome operation and a low mounting efficiency.

For another, the heating wire has different dimensions, however, since the screw hole currently used for mounting the heating wire usually has a fixed aperture, the user cannot use heating wires having different diameters on the same atomizer, which results in poor user experience.

SUMMARY

In the light of at least one of the technical problems described above, the present invention provides an atomizer and an E-cigarette thereof, it is possible to quickly mount and secure or replace the heating element, such that a user uses only hands for operation but without the help of a mounting tool.

In order to solve at least one of the technical problems described above, the present invention provides technical solutions as follows:

An atomizer including an atomizing assembly, where the atomizing assembly includes a heating element and a terminal connected to the heating element, and the atomizing assembly also includes a heating element securing device, the heating element is secured to the terminal by the heating element securing device, the heating element securing device includes a holding portion which is movably provided on the terminal, a movement of the holding portion enables the holding portion to be separated from or closed to the terminal, when the holding portion is closed to the terminal, the heating element is held between the holding portion and the terminal.

In one of implementations, the heating element securing device also includes a first elastic member, one end of the first elastic member provides an elastic resistance to a side of the holding portion away from the terminal, and the first elastic member makes the holding portion tend to be in a closure status with the terminal.

In one of implementations, the heating element securing device also includes a guiding post, one end of the guiding post is securely connected to the terminal, the other end of the guiding post is provided with a restricting portion, the holding portion is sheathed on the guiding post and is slidable in an axial direction of the guiding post, and the other end of the first elastic member provides an elastic resistance to the restricting portion.

In one of implementations, the holding portion comprises a mounting portion extending in the axial direction of the atomizer and a crimping portion provided at one end of the mounting portion and perpendicular to the mounting portion; and a guiding groove is opened in the axial direction of the holding portion, and penetrates through the mounting portion and the crimping portion; one end of the guiding post opposite to the restricting portion penetrates through the guiding groove and is securely connected to the terminal; the side of the holding portion away from the terminal is a groove bottom wall of the guiding groove; and the terminal is provided with a groove; when the holding portion is closed to the terminal, the mounting portion is accommodated in the groove, and the crimping portion is in close contact with the terminal.

In one of implementations, the heating element securing device further includes a third elastic member, the holding portion is rotatably provided on the terminal, the third elastic member provides an elastic resistance to the terminal and the holding portion at both ends, and the third elastic member makes the holding portion tend to be in a closure status with the terminal.

In one of implementations, the heating element securing device also includes a fourth elastic member and a dog, the holding portion is rotatably provided on the terminal, the fourth elastic member provides an elastic resistance to the terminal and the holding portion at both ends, and the fourth elastic member makes the holding portion tend to be in a separation status with the terminal, and when the heating element is held between the holding portion and the terminal, the dog is used to secure the holding portion and the terminal.

In one of implementations, the terminal has a side plate which is overlapped with that of the holding portion, a first regulating groove is provided on the side plate of the holding portion, where the first regulating groove includes a first regulating groove wide end near a joint of the holding portion and the terminal and a first regulating groove narrow end away from the joint of the holding portion and the terminal, and the first regulating groove wide end is in communication with the first regulating groove narrow end; a second regulating groove corresponding to the first regulating groove is provided on the side plate of the terminal, and when the dog is provided at the first regulating groove wide end and a bottom end of the second regulating groove, the holding portion is separated from the terminal, and when the holding portion is rotated till the first regulating groove narrow end is aligned with atop end of the second regulating groove and the dog is provided at the first regulating groove narrow end and the top end of the second regulating groove, the holding portion is closed to the terminal.

In one of implementations, the atomizer also includes a liquid guiding element, the atomizing assembly also includes a base and a rotary retainer ring mounted on the base, the base is provided with a securing groove, the rotary retainer ring is provided with a baffle for covering/opening the securing groove, an end of the liquid guiding element is inserted into the securing groove, and the end of the liquid guiding element is secured between a side wall of the baffle and a corresponding groove wall of the securing groove by rotating the rotary retainer ring.

In one of implementations, the atomizer also includes a second elastic member, the baffle is provided with a block at one side, a lower end of the block is inserted into the securing groove, an upper end of the block protrudes beyond an upper end of the rotary retainer ring, one end of the second elastic member provides an elastic resistance to the lower end of the block, and the other end of the second elastic member provides an elastic resistance to a groove wall of the securing groove facing the block.

An E-cigarette, where the E-cigarette includes any one of the atomizer as described above.

The present invention has the following advantageous effects: it is possible to achieve securing of a heating element through a heating element securing device, such that a user uses only hands for operation but without an external mounting tool, rendering that the heating element can be quickly mounted or replaced, thereby resulting in simple and easy operation.

In order to solve at least one of the technical problems described above, the invention also provides an atomizer and an E-cigarette thereof, which allows securing of various heating wires having different diameters, with convenient mounting and simple operation.

In order to solve at least one of the technical problems described above, the prevent invention provides technical solutions as follows:

An atomizer including an atomizing assembly, where the atomizing assembly includes a heating wire and a terminal connected to the heating wire, and the atomizing assembly also includes a heating element securing device, the heating wire is secured to the terminal by the heating element securing device, the heating element securing device includes a sleeving and a securing head with a lower end connected to the terminal, a bore for accommodating the heating wire is formed inside the securing head, an upper end of the securing head is a wiring portion, an inner diameter at a lower end of the sleeving is larger than an outer diameter at a lower end of the wiring portion, an inner diameter at an upper end of the sleeving is smaller than an outer diameter at an upper end of the wiring portion, when the sleeving is sheathed on an outer circumference of the securing head, the upper end of the sleeving is pressed against the upper end of the wiring portion, such that the upper end of the wiring portion holds tightly the heating wire.

In one of implementations, the sleeving is internally provided with a tapered groove, the wiring portion is tapered and is sheathed inside the tapered groove, an inner diameter at a lower end of the tapered groove is larger than the outer diameter at the lower end of the wiring portion, and an inner diameter at an upper end of the tapered groove is smaller than the outer diameter at the upper end of the wiring portion.

In one of implementations, an external thread is provided at an outer circumference of the terminal, the sleeving is internally provided with an internal thread, and the sleeving is threadedly connected to the terminal after being sheathed on the outer circumference of the securing head.

In one of implementations, the wiring portion has a multi-flap structure enclosed by a plurality of lamellar flaps.

In one of implementations, the plurality of lamellar flaps is on a same circumference, and a gap is left between adjacent lamellar flaps.

In one of implementations, the plurality of lamellar flaps is located on two circumferences, a gap is left between adjacent lamellar flaps on each circumference, and the lamellar flaps on one circumference and the lamellar flaps on the other circumference are staggered and overlapped.

In one of implementations, the sleeving is provided with an anti-slip groove outside.

In one of implementations, the sleeving is internally provided with a channel in communication with the bore, and the heating wire penetrates through the channel into the bore.

In one of implementations, the sleeving is an annular ring.

An E-cigarette comprising any one of the atomizer as described above.

The present invention has the following advantageous effects: it is possible to achieve securing of various heating wires having different diameters through a heating element securing device, and the heating wires can be quickly and conveniently mounted, in an easy operation.

Figure 1:
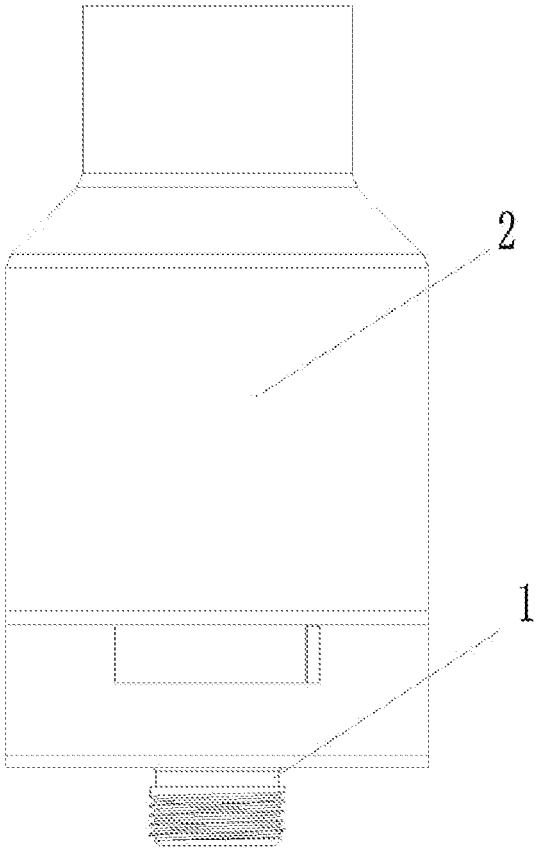
FIG. 1 is a schematic structural view of an atomizer according to Embodiment 1.
Figure 2:
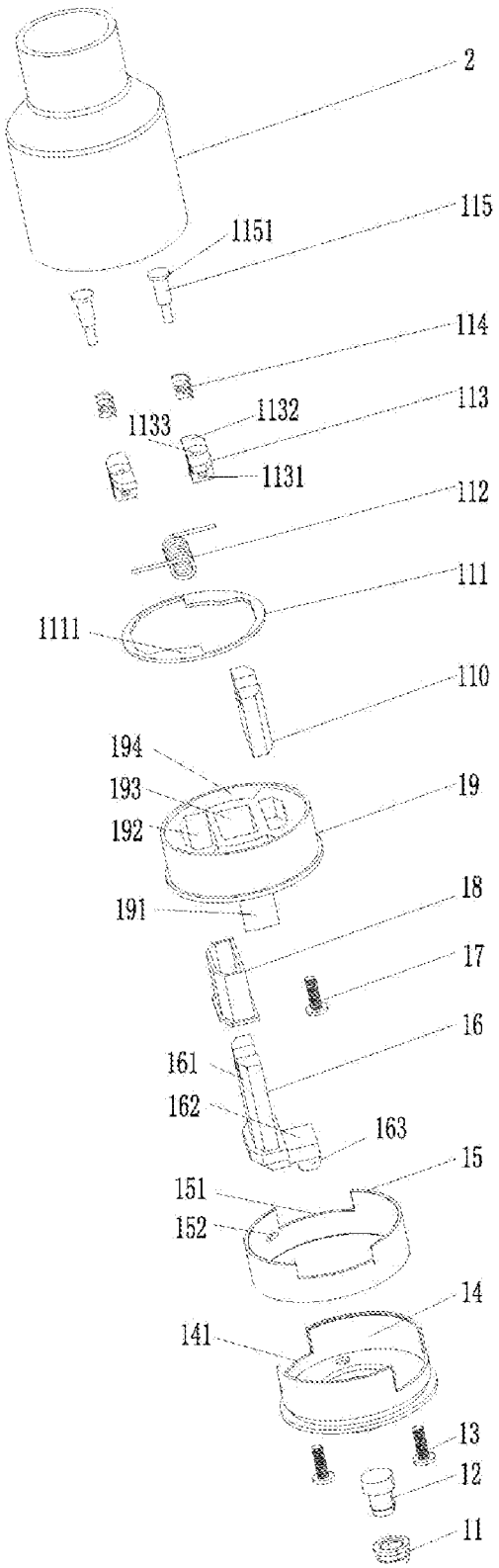
FIG. 2 is an exploded view of the atomizer as shown in FIG. 1.
Figure 3:
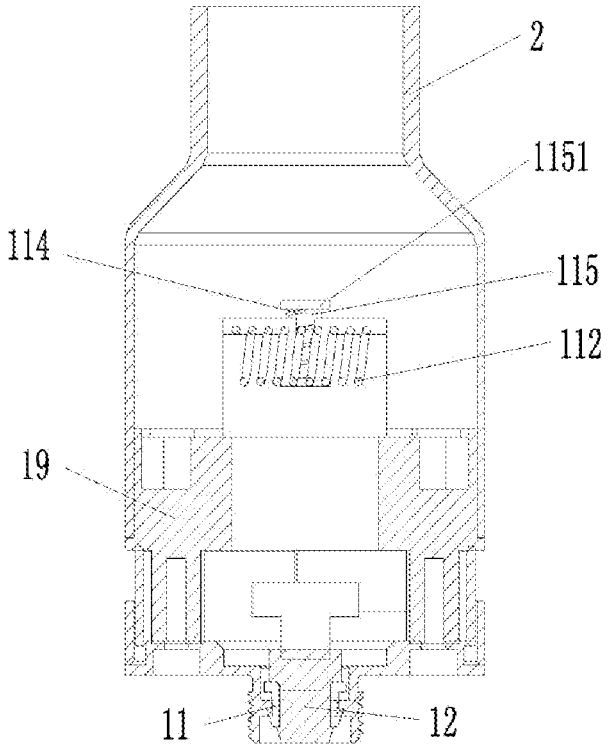
FIG. 3 is a schematic cross-sectional view of the atomizer as shown in FIG. 1.
Figure 4:
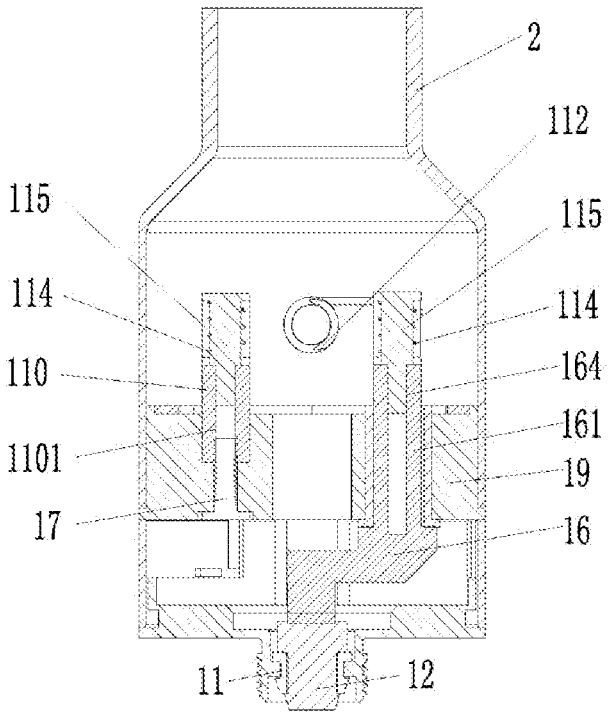
FIG. 4 is a schematic cross-sectional view of the atomizer as shown in FIG. 1 from another perspective.
Figure 5:
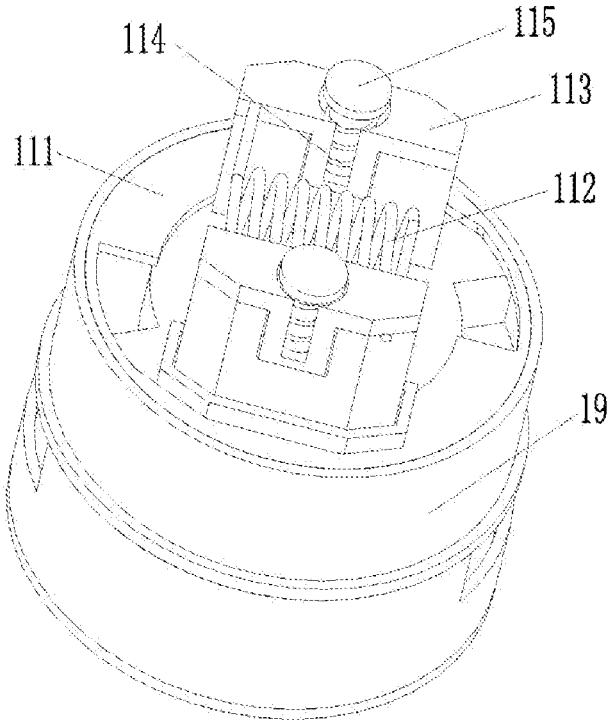
FIG. 5 is a perspective view of a structure of an atomizing assembly as shown in FIG. 1.
Figure 6:
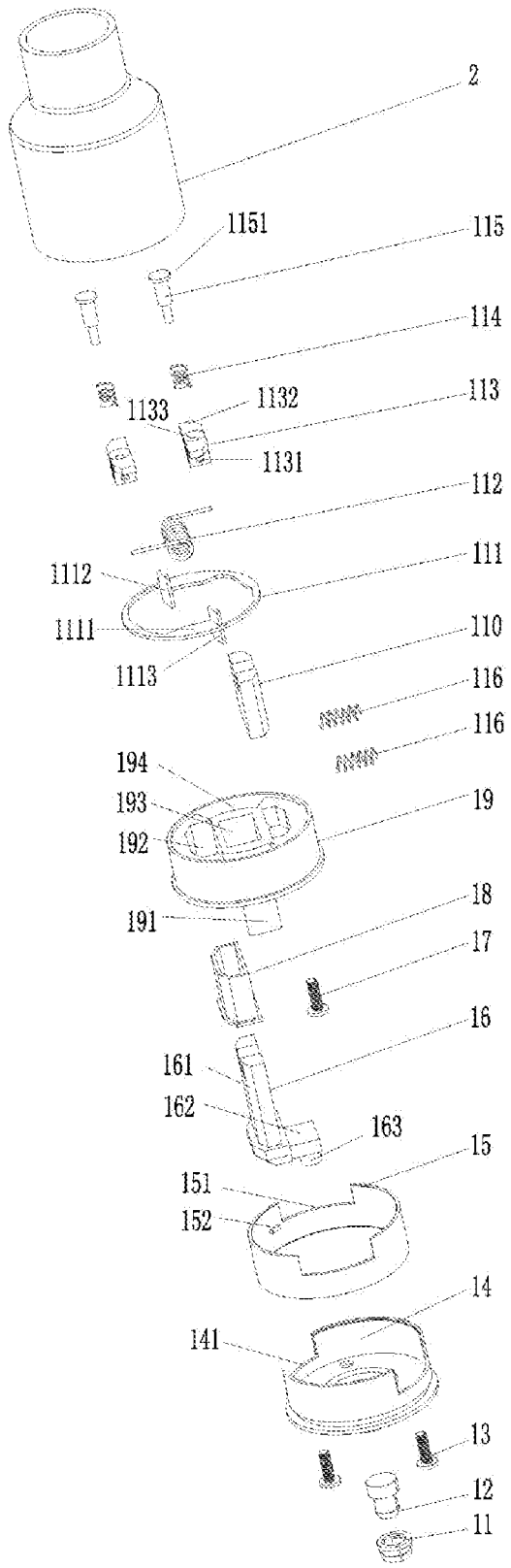
FIG. 6 is an exploded view of an atomizer according to Embodiment 2.
Figure 7:
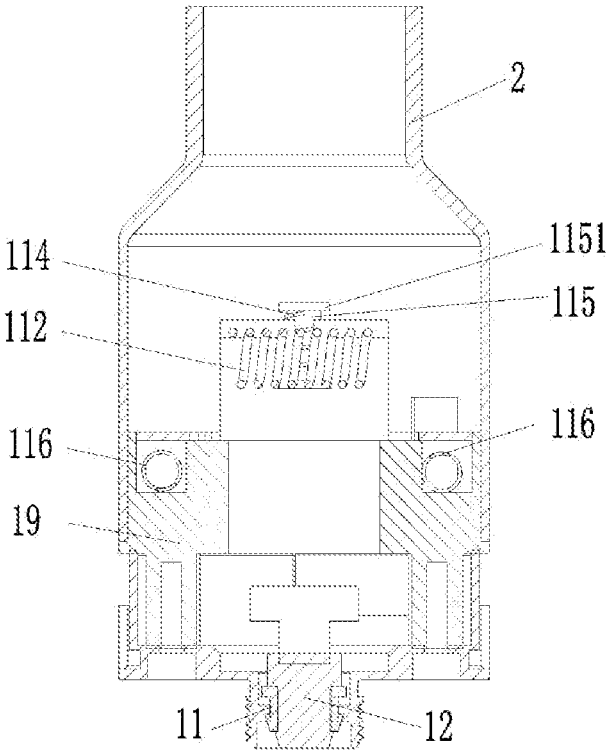
FIG. 7 is a schematic cross-sectional view of the atomizer according to Embodiment 2.

In the drawings, 1: atomizing assembly; 2: housing; 11, 32, 3: first insulating member; 12, 33, 4: positive contact; 13: first fastening member; 14: connecting ring; 141, 311, 5-1: air intake groove; 15: air regulating ring; 151: air regulating groove; 152: positioning protrusion; 16, 7: positive post; 161, 7-1: wiring end; 162, 7-2: conducting end; 163: conducting post; 164: second mounting hole; 17: second fastening member; 18, 6: second insulating member; 19: base; 191: connecting post; 192: mounting groove; 193: air vent; 194: securing groove; 110, 22: negative post; 1101: first mounting hole; 111: rotary retainer ring; 1111: baffle; 1112: first block; 1113: second block; 112, 10: heating element; 113: cover plate; 1131: mounting portion; 1132: crimping portion; 1133: guiding groove; 114: first elastic member; 115: guiding post; 1151: restricting portion; 116: second elastic member; 117: heating element holder; 118: first securing shaft; 119: third elastic member; 120: liquid guiding element; 31, 5: mounting base; 312: first positioning groove; 313: second positioning groove; 314: fitting groove; 3141: curved end; 34: insulating socket; 341: third positioning groove; 35: positive socket; 351: positioning hole; 352: fourth positioning groove; 36: securing member; 37: second securing shaft; 38: first clip; 381: first regulating groove; 3811: first regulating groove wide end; 3812: first regulating groove narrow end; 382: first clip opening groove; 39: second clip; 391: second regulating groove; 392: second clip opening groove; 40: fourth elastic member; 41: dog; 2-1: through hole; 8: securing head; 8-1: lamellar flap; 8-2: wiring portion; 8-3: bore; 9: sleeving; 9-1: channel; 9-2: anti-slip groove; 21: upper cover; 21-1: sucking portion.

DETAILED DESCRIPTION

The present invention will be described hereunder in further detail with reference to the accompanying drawings and specific embodiments, so that those skilled in the art may better understand and implement the present invention, however, the embodiments are not to be construed as limiting the present invention.

Embodiment 1

As shown in FIG. 1, an atomizer convenient for securing a heating element includes a housing 2 and an atomizing assembly 1. The atomizing assembly 1 is mounted in the housing 2 at one end and exposed outside the housing 2 at the other end.

As shown in FIG. 2 to FIG. 5, the atomizing assembly 1 includes a first insulating member 11, a positive contact 12, a connecting ring 14 and an air regulating ring 15. The positive contact 12 is sheathed in the first insulating member 11 and is centrally mounted at a bottom end of the connecting ring 14 together with the first insulating member 11, and the air regulating ring 15 is rotatably sheathed outside the connecting ring 14. An air intake groove 141 is opened on a side wall of the connecting ring 14; an air regulating groove 151 corresponding to the air intake groove 141 is opened on a side wall of the air regulating ring 15, and a rotation of the air regulating ring 15 may regulate a communication area between the air regulating groove 151 and the air intake groove 141, thereby regulating the amount of air into the atomizer A positioning protrusion 152 is further provided on an inner wall of the air regulating ring 15. When the air regulating ring 15 is rotated till the positioning protrusion 152 is stopped by a groove wall at one side of the air intake groove 141, there is a maximum communication area between the air regulating groove 151 and the air intake groove 141; and when the air regulating ring 15 is rotated till the positioning protrusion 152 is stopped by a groove wall at the other side of the air intake groove 141, there is a minimum communication area between the air regulating groove 151 and the air intake groove 141.

The atomizing assembly 1 also includes a base 19, a heating element 112, a terminal and a heating element securing device. The base 19 is mounted on the connecting ring 14; the base 19 is fitted with the connecting ring 14 to commonly form a mounting base; the terminal is mounted on the base 19; and the heating element 112 is secured to the terminal by the heating element securing device. In this embodiment, the heating element 112 is a heating wire. It will be appreciated that, in other embodiments, the heating element 112 may also be a heating rod or a heating sheet. When the heating element 112 is the heating rod, leading wires may be provided at both ends of the heating rod and are used as leading ends, for the heating element securing device to hold and secure the leading wires.

The atomizing assembly 1 also includes two first fastening members 13, through which the connecting ring 14 is connected to the base 19. In particular, the base 19 has two connecting posts 191 located at a lower surface thereof, and the two connecting posts 191 extend downward in an axial direction of the base 19. The first fastening members 13 penetrate through the bottom end of the connecting ring 14 into an inner cavity of the connecting ring 14 and are connected to the corresponding connecting posts 191, thereby securing the base 19. In this embodiment, both of the first fastening members 13 are pins, and both of the first fastening members 13 are in an interference fit with the corresponding connecting posts 191. It is to be understood that the number of the connecting posts 191 is not limited, which only needs to cooperate with the first fastening members 13 so that the base 19 can be secured. In other embodiments, the number of the connecting posts 191 may be one or more, and only if the number of the first fastening members 13 is corresponding to the number of the connecting posts 191. It will be appreciated that, in other embodiments, the first fastening members 13 may also be connected to the corresponding connecting posts 191 through other means, such as a threaded connection.

In this embodiment, there are two terminals, which are a positive post 16 and a negative post 110, respectively. One leading end of the heating element 112 is secured to the positive post 16 by one heating element securing device, and the other leading end of the heating element 112 is secured to the negative post 110 by another heating element securing device. Both the positive post 16 and the negative post 110 are mounted on the base 19.

The atomizing assembly 1 also includes a second insulating member 18 and a second fastening member 17. An air vent 193 is opened at the center of the base 19. Two mounting grooves 192, on two opposite sides of the air vent 193, are opened on the base 19. The positive post 16 is substantially L-shaped. An end of the positive post 16, at which the positive post 16 extends upward in the axial direction of the atomizer, is a wiring end 161, and an end of the positive post 16, at which the positive post 16 extends inward in the radial direction of the atomizer, is a conducting end 162. The wiring end 161 extends from a bottom end of the base 19 into one of the mounting grooves 192 and penetrates through a top end of the base 19, the conducting end 162 is aligned with the positive contact 12, and a conducting post 163 electrically connected to the positive contact 12 is formed on the conducting end 162 extending axially downward along the atomizer The second insulating member 18 is provided between the positive post 16 and the base 19, allowing the positive post 16 to be insulated from the base 19. A bottom end of the negative post 110 is inserted from the top end of the base 19 into the other mounting groove 192; in the axial direction of the negative post 110, the negative post 110 is opened with a first mounting hole 1101 penetrating through both ends of the negative post 110; the second fastening member 17 extends from the bottom end of the base 19 into the other mounting groove 192 up to a bottom end of the first mounting hole 1101 to secure the negative post 110. In this embodiment, the second fastening member 17 is a screw. At the bottom end of the first mounting hole 1101, there is internally provided with an internal thread, and the second fastening member 17 is threadedly connected to the bottom end of the first mounting hole 1101, thereby securing the negative post 110. It will be appreciated that, in other embodiments, the second fastening member 17 may be secured to the bottom end of the first mounting hole 1101 in other ways, such as an interference fit.

In this embodiment, the heating element securing device includes a cover plate 113 (i.e., a holding portion), a guiding post 115 and a first elastic member 114. The cover plate 113 is substantially T-shaped, including a mounting portion 1131 extending in the axial direction of the atomizer and a crimping portion 1132 provided at one end of the mounting portion 1131 and perpendicular to the mounting portion 1131. In the axial direction of the cover plate 113, there is opened with a guiding groove 1133 penetrating through the mounting portion 1131 and the crimping portion 1132; the guiding post 115 is securely connected to the terminal after penetrating through the guiding groove 1133; and the guiding post 115 is provided with a restricting portion 1151 at an end away from the terminal. A diameter of the guiding post 115<a diameter of a bottom of the guiding groove 1133<a diameter of the restricting portion 1151 of the guiding post 115, and a diameter of the remaining portion of the guiding groove 1133>the diameter of the restricting portion 1151 of the guiding post 115, thereby allowing the cover plate 113 to be slidable in the axial direction of the guiding post 115 and not disengaged from the guiding post 115. The first elastic member 114 is sheathed on an outer circumference of the guiding post 115 with one end elastically resisting the restricting portion 1151 of the guiding post 115 and the other end elastically resisting a groove bottom wall of the guiding groove 1133. In this embodiment, the first elastic member 114 uses a compression spring. The guiding post 115 is a pin, and the restricting portion 1151 is a cap of the pin.

In one heating element securing device, the guiding post 115 is secured to the positive post 16. In particular, the cover plate 113 is sheathed on the guiding post 115 through the guiding groove 1133 and is slidable in the axial direction of the guiding post 115; in the axial direction of the wiring end 161 of the positive post 16, there is opened with a second mounting hole 164, a bottom end of the guiding post 115 is in an interference fit with a top end of the second mounting hole 164; the first elastic member 114 is provided between a groove bottom wall of the guiding groove 1133 and the restricting portion 1151 of the guiding post 115; and when the cover plate 113 is sliding relative to the guiding post 115, the crimping portion 1132 is away from or pressed against the wiring end 161 of the positive post 16.

In another heating element securing device, the guiding post 115 is secured to the negative post 110. In particular, the cover plate 113 is sheathed on the guiding post 115 through the guiding groove 1133 and is slidable in the axial direction of the guiding post 115; a bottom end of the guiding post 115 is in an interference fit with a top end of the first mounting hole 1101; the first elastic member 114 is provided between a groove bottom wall of the guiding groove 1133 and the restricting portion 1151 of the guiding post 115; and when the cover plate 113 is sliding relative to the guiding post 115, the crimping portion 1132 is away from or pressed against the negative post 110.

In this embodiment, both the positive post 16 and the negative post 110 are provided with grooves for accommodating the mounting portions 1131, so that the mounting portions 1131 of the cover plates 113 are accommodated in the corresponding grooves in the natural state, and the crimping portions 1132 may be in close contact with the positive post 16 and the negative post 110.

The heating element securing device in this embodiment has the following operating principles:

When the heating element 112 requires to be secured, the cover plate 113 is lifted such that the cover plate 113 is away from the positive post 16, to place a leading end of the heating element 112 on the positive post 16, and the cover plate 113 is released, such that the cover plate 113 is automatically reset under the elastic force of the first elastic member 114, to press against the leading end of the heating element 112.

Likewise, the other leading end of the heating element 112 is secured by another heating element securing device, that is, the cover plate 113 is lifted such that the cover plate 113 is away from the negative post 110, to place the other leading end of the heating element 112 on the negative post 110, and the cover plate 113 is released, such that the cover plate 113 is automatically reset under the elastic force of the first elastic member 114, to press against the other leading end of the heating element 112.

It will be appreciated that, in other embodiments, the cover plate 113 may further be in flat shape. The cover plate 113 is provided with a guiding hole penetrating through upper and lower surfaces of the cover plate 113, a diameter of the guiding post 115<a diameter of the guiding hole<a diameter of the restricting portion 1151 of the guiding post 115, the guiding post 115 is securely connected to the terminal after penetrating through the guiding hole, and the first elastic member 114 is sheathed on an outer circumference of the guiding post 115 with one end elastically resisting the restricting portion 1151 of the guiding post 115 and the other end elastically resisting the upper surface of the cover plate 113. Thus, the cover plate 113 is lifted such that the lower surface of the cover plate 113 is away from the terminal, the first elastic member 114 is compressed between the upper surface of the cover plate 113 and there stricting portion 1151 of the guiding post 115, and after the leading end of the heating element 112 is placed on the terminal, the cover plate 113 is released such that the cover plate 113 is automatically reset under the elastic force of the first elastic member 114, and the lower surface of the cover plate 113 is pressed against the leading end of the heating element 112.

The atomizer also includes a liquid guiding element (not shown), in this embodiment, the heating element 112 is a heating wire wound around the outer circumference of the liquid guiding element. After removing the housing 2, dripping smoke liquid onto the liquid guiding element, then covering with the housing 2, the user connects the atomizer to a battery device (not shown) of the E-cigarette electrically, for use. When in use, the outside air flows into the heating element 112 through an air regulating groove 151, an air intake groove 141 and an air vent 193, and flows out from an opening at a top end of the housing 2 after being mixed with smoke produced from the smoke liquid atomized by the heating element 112.

In this embodiment, in order to secure both ends of the liquid guiding element, the base 19 is also mounted with a rotary retainer ring 111, and the base 19 is also opened with two securing grooves 194. Two baffles 1111 are provided on the rotary retainer ring 111 corresponding to the two securing grooves 194. The liquid guiding element is secured by the user manually rotating the rotary retainer ring 111. A specific process is that: after the heating wire is wound around the liquid guiding element, the user manually rotates the rotary retainer ring 111 to allow the baffles 1111 of the rotary retainer ring 111 to be away from the securing grooves 194 with an exposed opening of the securing grooves 194 to be enlarged, both ends of the liquid guiding element are placed in the corresponding securing grooves 194 on the base 19 and then the rotary retainer ring 111 is manually rotated to allow the baffles 1111 to gradually cover the securing grooves 194, so that the exposed opening of the securing grooves 194 are gradually decreased, and finally the liquid guiding element is held tight by side walls of the baffles 1111 and corresponding groove walls of the securing grooves 194.

This embodiment also provides an E-cigarette including the atomizer.

Embodiment 2

Embodiment 2 differs from Embodiment 1 in that:

As shown in FIG. 6 to FIG. 9, on an inner wall of the rotary retainer ring 111, there is provided with two blocks, which area first block 1112 and a second block 1113, respectively. The first block 1112 is secured to a side wall of one of the baffles 1111; the second block 1113 is secured to a side wall of the other one of the baffles 1111. A lower end of the first block 1112 is inserted into one of the securing grooves 194 of the base 19; and a lower end of the second block 1113 is inserted into the other one of the securing grooves 194 of the base 19. Both an upper end of the first block 1112 and an upper end of the second block 1113 protrude beyond an upper end of the rotary retainer ring 111. In this embodiment, the securing grooves 194 are fan-shaped grooves.

Both securing grooves 194 are provided with second elastic members 116. One end of a second elastic member 116 in one of the securing grooves 194 provides an elastic resistance to the lower end of the first block 1112, and the other end provides an elastic resistance to the groove wall of the one of the securing grooves 194 facing the first block 1112; likewise, one end of a second elastic member 116 in the other one of the securing grooves 194 provides an elastic resistance to the lower end of the second block 1113, and the other end provides an elastic resistance to the groove wall of the other one of the securing grooves 194 facing the second block 1113. In this embodiment, both of the second elastic members 116 are springs.

Figure 8:
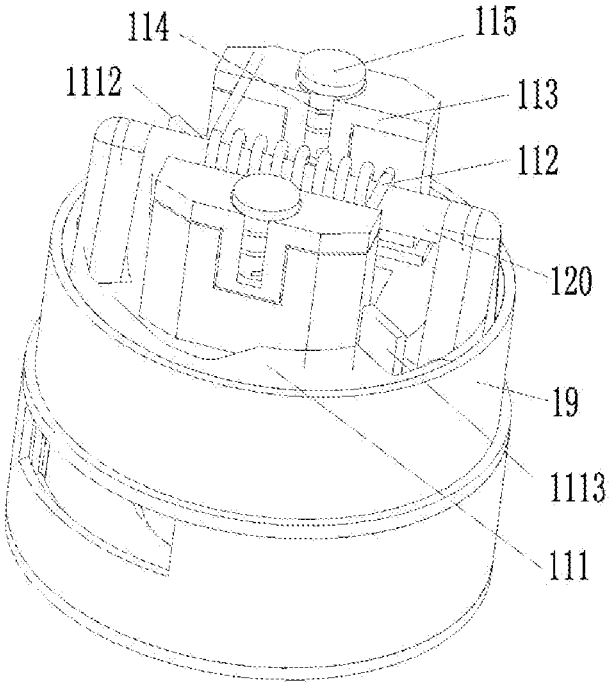
FIG. 8 is a schematic structural view of anatomizing assembly with a liquid guiding element unlocked in Embodiment 2.
Figure 9:
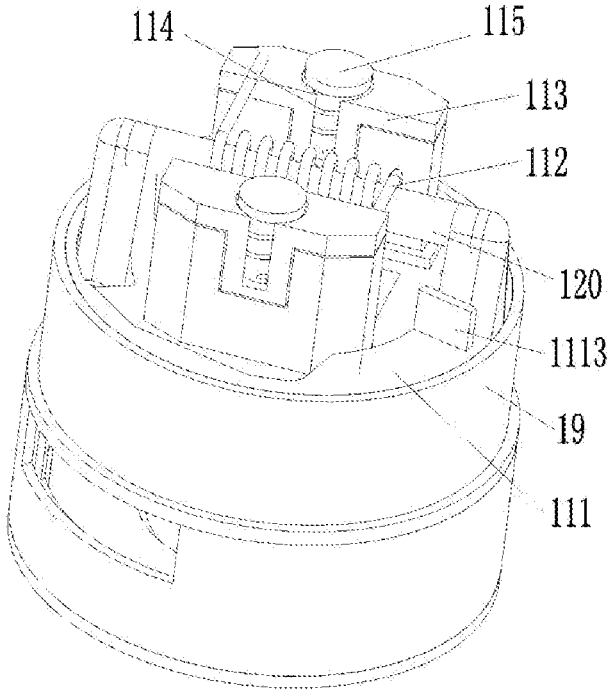
FIG. 9 is a schematic structural view of the atomizing assembly with the liquid guiding element locked in Embodiment 2.

According to this embodiment, the rotary retainer ring 111 may be automatically reset, and thus the liquid guiding element 120 is automatically secured and held. Specific principles lie in that, after the heating wire is wound around the liquid guiding element 120, the rotary retainer ring 111 is rotated through the upper end of the first block 1112 or the upper end of the second block 1113, so that openings of both securing grooves 194 are enlarged, place both ends of the liquid guiding element 120 respectively in the corresponding securing grooves 194, release the rotary retainer ring 111, then the rotary retainer ring 111 is automatically reset under elastic forces of both second elastic members 116 to hold tight the liquid guiding element 120, thereby achieving securing of the liquid guiding element 120. FIG. 9 shows a state after the liquid guiding element 120 is secured, and FIG. 8 shows a state before the liquid guiding element 120 is secured.

Embodiment 3

Figure 10:
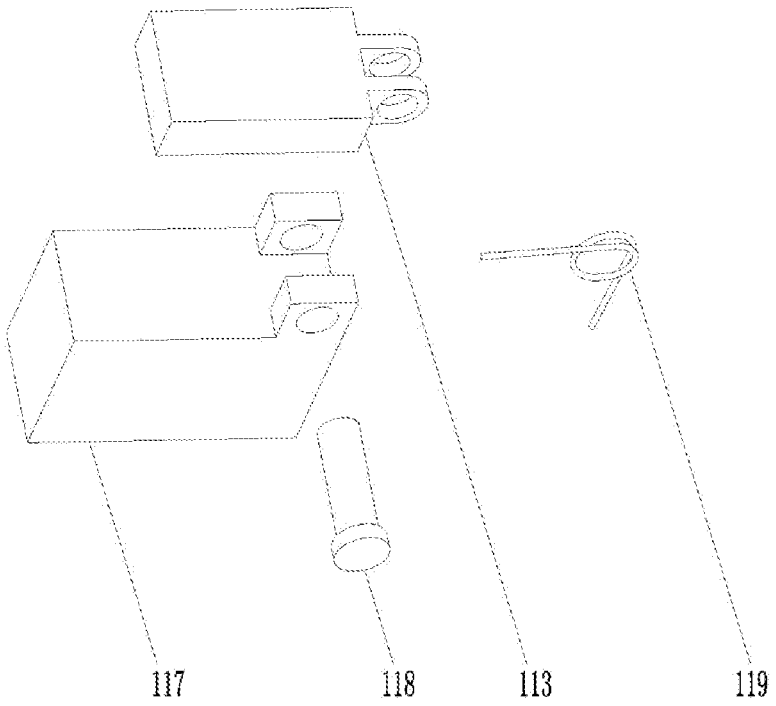
FIG. 10 is an exploded view of a heating element securing device according to Embodiment 3.
Figure 11:
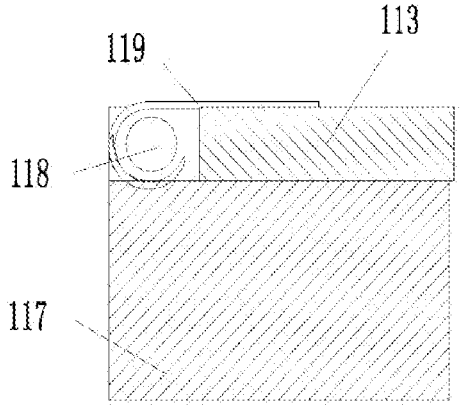
FIG. 11 is a schematic cross-sectional view of the heating element securing device when it is locked according to Embodiment 3.
Figure 12:
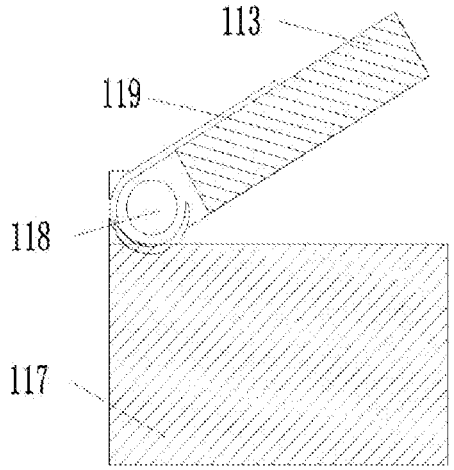
FIG. 12 is a schematic cross-sectional view of the heating element securing device when it is unlocked according to Embodiment 3.

As shown in FIG. 10 to FIG. 12, Embodiment 3 provides another way for fitting a heating element securing device with a terminal.

In this embodiment, the terminal is a heating element holder 117, which is used as a positive post or a negative post. The heating element securing device includes a cover plate 113 (i.e., a holding portion), a first securing shaft 118 and a third elastic member 119. The cover plate 113 is rotatably provided on the heating element holder 117 by the first securing shaft 118; the first securing shaft 118 is sheathed with the third elastic member 119; both ends of the third elastic member 119 provide an elastic resistance to the heating element holder 117 and the cover plate 113, respectively; the third elastic member 119 makes the heating element holder 117 tend to be in a closure status with the cover plate 113. In this embodiment, the third elastic member 119 is a torsion spring. In this embodiment, the cover plate 113 is rotatably provided on the heating element holder 117 by being hinged to the heating element holder 117.

FIG. 11 shows a closure state when the heating element securing device locks the heating element; and FIG. 12 shows an opening state when the heating element securing device unlocks the heating element.

The heating element securing device in this embodiment has the following operation principles:

when the heating element requires to be secured, the cover plate 113 is rotated such that the cover plate 113 is separated from the heating element holder 117, a leading end of the heating element is placed on the heating element holder 117 and the cover plate 113 is released, such that the cover plate 113 is automatically reset under the elastic force of the third elastic member 119 to press against the leading end of the heating element.

Embodiment 4

Figure 13:
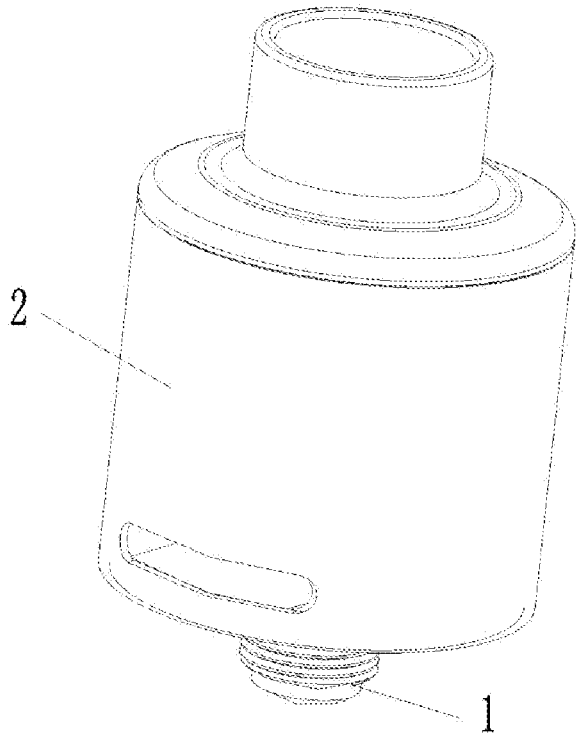
FIG. 13 is a schematic structural view of an atomizer according to Embodiment 4.

As shown in FIG. 13, an atomizer convenient for securing a heating element, includes a housing 2 and an atomizing assembly 1, where the atomizing assembly 1 is mounted in the housing 2.

Figure 14:
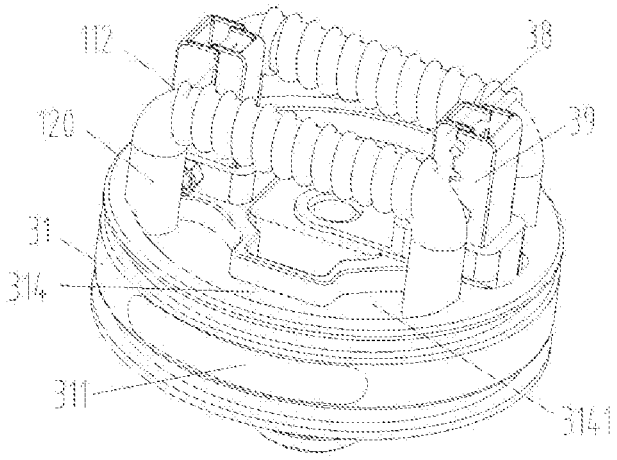
FIG. 14 is a schematic structural view of an atomizing assembly as shown in FIG. 13.
Figure 15:
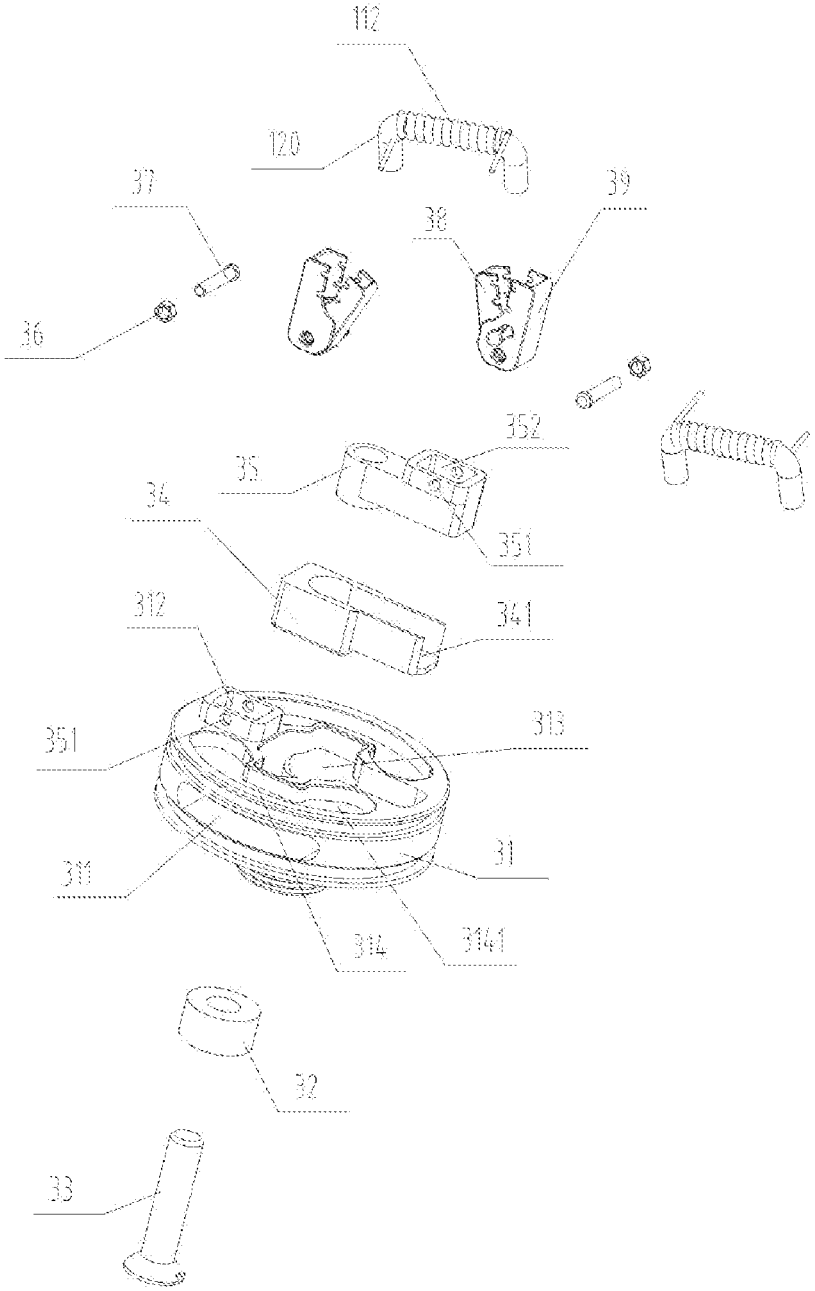
FIG. 15 is an exploded view of the atomizing assembly as shown in FIG. 14.

As shown in FIG. 14 and FIG. 15, the atomizing assembly 1 includes a mounting base 31, a heating element 112, a terminal, a heating element securing device and a liquid guiding element 120. The terminal is provided on the mounting base 31, the heating element 112 is arranged to be at least partially in contact with the liquid guiding element 120, and a leading end of the heating element 112 is secured to the terminal by the heating element securing device. In this embodiment, the heating element 112 is a heating wire wound around the liquid guiding element 120. It will be appreciated that, in other embodiments, the heating element 112 may also be a heating rod or a heating sheet. When the heating element 112 is the heating rod, leading wires may be provided at both ends of the heating rod and are used as leading ends, for the heating element securing device to hold and secure the leading wires.

Figure 16:
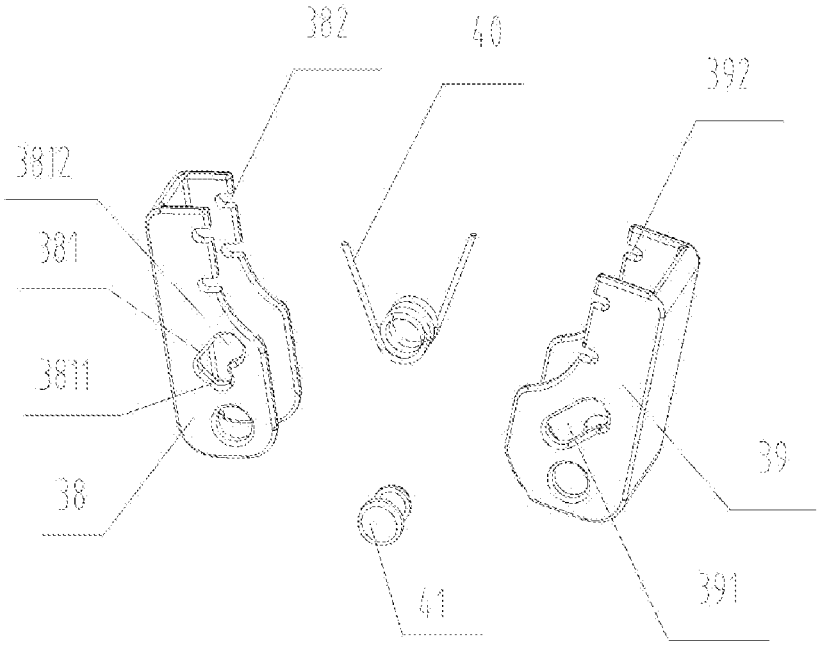
FIG. 16 is an exploded view of assembly of a first clip and a second clip as shown in FIG. 15.
Figure 17:
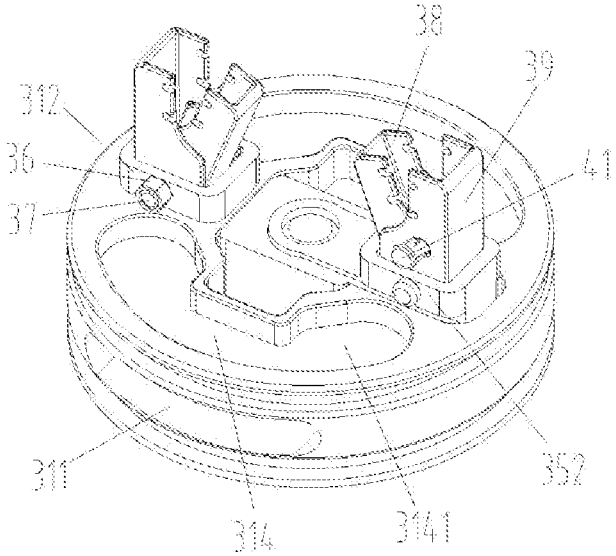
FIG. 17 is a schematic structural view of the atomizing assembly as shown in FIG. 14 with a heating element and a liquid guiding element removed.

As shown in FIG. 16 and FIG. 17, the heating element securing device includes a first clip 38, a fourth elastic member 40 and a dog 41, where the first clip 38 is then a holding portion. The terminal is a second clip 39. The first clip 38 is rotatably mounted on the second clip 39. The fourth elastic member 40 provides an elastic resistance to an inner wall of the first clip 38 and an inner wall of the second clip 39 at both ends, and makes the first clip 38 and the second clip 39 tend to be in an open status. After the leading end of the heating element 112 is placed between the first clip 38 and the second clip 39, the first clip 38 is rotated till the first clip 38 and the second clip 39 hold tight the heating element 112, and then the first clip 38 and the second clip 39 are secured by the dog 41 to prevent separation thereof, and thus the securing of the heating element 112 is completed. In this embodiment, the fourth elastic member 40 is a torsion spring.

In this embodiment, the first clip 38 and the second clip 39 each has two side plates, the side plates of the first clip 38 are opposed to the side plates of the second clip 39, and the side plates of the first clip 38 are covered with the corresponding side plates of the second clip 39. The heating element securing device also includes a second securing shaft 37. The second securing shaft 37 successively penetrates through bottom ends of the four side plates to allow the first clip 38 to be hinged to the second clip 39. The fourth elastic member 40 is sheathed on the second securing shaft 37 with both ends elastically resisting the inner wall of the first clip 38 and the inner wall of the second clip 39, which makes the first clip 38 and the second clip 39 tend to be in an open status.

A first regulating groove 381 is provided on one side plate of the first clip 38, where the first regulating groove 381 includes a first regulating groove wide end 3811 near the hinge and a first regulating groove narrow end 3812 away from the hinge, the first regulating groove wide end 3811 is in communication with the first regulating groove narrow end 3812 to form an inclined "L" shape. A second regulating groove 391 corresponding to the first regulating groove 381 is opened on a side plate of the second clip 39. The first regulating groove wide end 3811 has a width larger than that of the first regulating groove narrow end 3812. The width of the first regulating groove narrow end 3812 and the width of the second regulating groove 391 are equivalent to a diameter of the dog 41. The dog 41 successively penetrates through a bottom end of the second regulating groove 391 and the first regulating groove wide end 3811, and since the first clip 38 and the second clip 39 tends to be in an opening status, a top end of the second regulating groove 391 and the first regulating groove narrow end 3812 are in an offset state. After the leading end of the heating element 112 is placed between the first clip 38 and the second clip 39, the first regulating groove narrow end 3812 is also rotating toward the second clip 39 while the first clip is rotated, and finally the first regulating groove narrow end 3812 is aligned with the top end of the second regulating groove 391, at this point, the dog 41 may slide upward till being caught into the top end of the second regulating groove 391 and the first regulating groove narrow end 3812, thereby preventing the top end of the second regulating groove 391 from being separated from the first regulating groove narrow end 3812, i.e., preventing the first clip 38 from being separated from the second clip 39, and thus the securing of the heating element 112 is completed.

The first clip 38 is provided with an opening groove for accommodating the heating element, and so is the second clip 39. The opening groove provided on the first clip 38 are first clip opening groove 382 as shown in FIG. 16, and the opening groove provided on the second clip 39 are second clip opening groove 392 as shown in FIG. 16, when the first clip 38 is closed to the second clip 39, the first clip opening groove 382 and the second clip opening groove 392 hold tight the heating element 112.

In this embodiment, the first clip opening groove 382 is provided on both side plates of the first clip 38, with two on each side plate, and thus there are totally four first clip opening grooves 382. The second clip opening groove 392 is provided on both side plates of the second clip 39, also with two on each side plate, and thus there are four second clip opening grooves 392. Each of the first clip opening grooves 382 and a corresponding one of the second clip opening grooves 392 form an annular structure for accommodating the heating element 112 when the first clip 38 is closed to the second clip 39, thereby securing the heating element 112.

In this embodiment, each leading end of the heating element 112 penetrates through two annular structures located at the same level, and one leading end of the heating element 112 is secured by the two annular structures, which may make the securing more reliable. It will be appreciated that, the number of the first clip opening grooves 382 and the number of the second clip opening grooves 392 are not limited, only if the number of the annular structures formed by the first clip opening grooves 382 and the corresponding second clip opening grooves 392 the number of the leading ends of the heating element 112. In this embodiment, there are two terminals, which are a positive terminal and a negative terminal, respectively. Therefore, there are two second clips 39, where one of the second clips 39 serves as the positive terminal, and the other one of the second clips 39 serves as the negative terminal.

An integral part formed by the second clip 39 served as the negative terminal and one heating element securing device is connected to the mounting base 31 through a first positioning groove 312, and an integral part formed by the second clip 39 served as the positive terminal and the other heating element securing device is connected to the mounting base 31 through a fourth positioning groove 352.

In particular, the mounting base 31 has a substantially disc-shaped structure, the first positioning groove 312 is provided on and protrudes from an upper surface of the mounting base 31, and a second positioning groove 313 opposite to the first positioning groove 312, is opened on the upper surface of the mounting base 31. The atomizer also includes an insulating socket 34, a positive socket 35 and a securing member 36. The insulating socket 34 is mounted in the second positioning groove 313 of the mounting base 31, and the insulating socket 34 insulates the positive terminal from the mounting base 31. The insulating socket 34 is opened with a third positioning groove 341, and the positive socket 35 is mounted in the third positioning groove 341. The fourth positioning groove 352 is provided on and protrudes from an upper surface of the positive socket 35.

Positioning holes 351 are provided on each of a pair of opposing groove walls of the first positioning groove 312. After the integral part formed by the second clip 39 served as the negative terminal and one heating element securing device is placed into the first positioning groove 312, the second securing shaft 37 successively penetrates through a positioning hole 351 of the groove wall at one side of the first positioning groove 312, the first clip 38, the second clip 39, and a positioning hole 351 of the groove wall at the other side of the first positioning groove 312, and finally is locked by the securing member 36.

Likewise, positioning holes 351 are provided on each of a pair of opposing groove walls of the fourth positioning groove 352. After the integral part formed by the second clip 39 served as the positive terminal and the other heating element securing device is placed into the fourth positioning groove 352, the second securing shaft 37 successively penetrates through a positioning hole 351 of the groove wall at one side of the fourth positioning groove 352, the first clip 38, the second clip 39, and a positioning hole 351 of the groove wall at the other side of the fourth positioning groove 352, and finally is locked by the securing member 36.

In this embodiment, the securing member 36 is a nut, and the second securing shaft 37 is a screw, both of which are locked by a thread fit.

Figure 18:
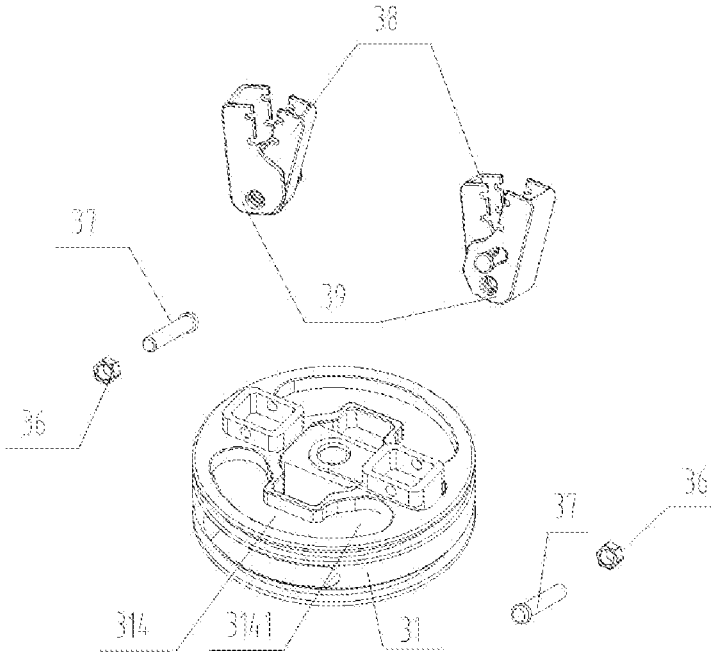
FIG. 18 is a schematic view of mounting a base and a heating element securing device.

FIG. 18 shows a state before the mounting base 31 is mounted with the heating element securing device and the terminal; and FIG. 17 shows a state after the mounting base 31 is mounted with the heating element securing device and the terminal.

The second clip 39 served as the negative terminal is kept tightly fitted with the first positioning groove 312, to ensure that the entire clip assembly is reliably secured without shaking; likewise, the second clip 39 served as the positive terminal is kept tightly fitted with the fourth positioning groove 352, to ensure that the entire clip assembly is reliably secured without shaking.

The heating element securing device in this embodiment has the following operation principles:

A bottom end of the first regulating groove 381 is the first regulating groove wide end 3811, the remaining part of the first regulating groove 381 is the first regulating groove narrow end 3812, the first regulating groove wide end 3811 has a width larger than that of the first regulating groove narrow end 3812, and the width of the first regulating groove narrow end 3812 and the width of the second regulating groove 391 are equivalent to a diameter of the dog 41. When the dog 41 is placed at the bottom end of the first regulating groove 381, the dog 41 is located at the first regulating groove wide end 3811 and a bottom end of the second regulating groove 391, since the width of the first regulating groove wide end 3811 is larger than the width of the second regulating groove 391, the first clip 38 and the second clip 39 show a V-shape under the elastic force of the fourth elastic member 40.

Figure 19:
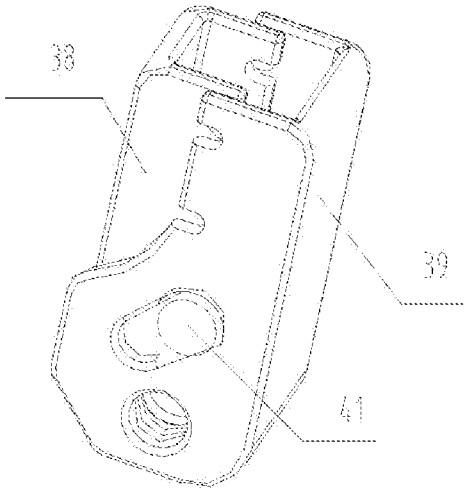
FIG. 19 is a schematic view of the status in which the first clip and the second clip are closed.
Figure 20:
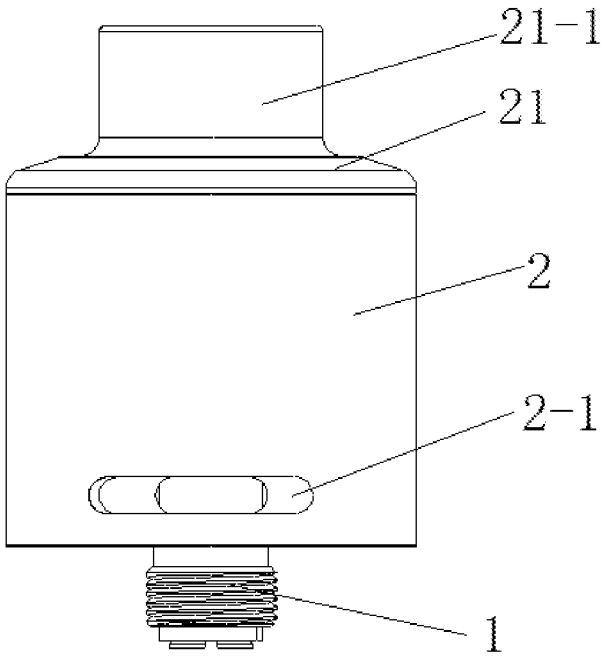
FIG. 20 is a schematic structural view of an atomizer according to Embodiment 5.
Figure 21:
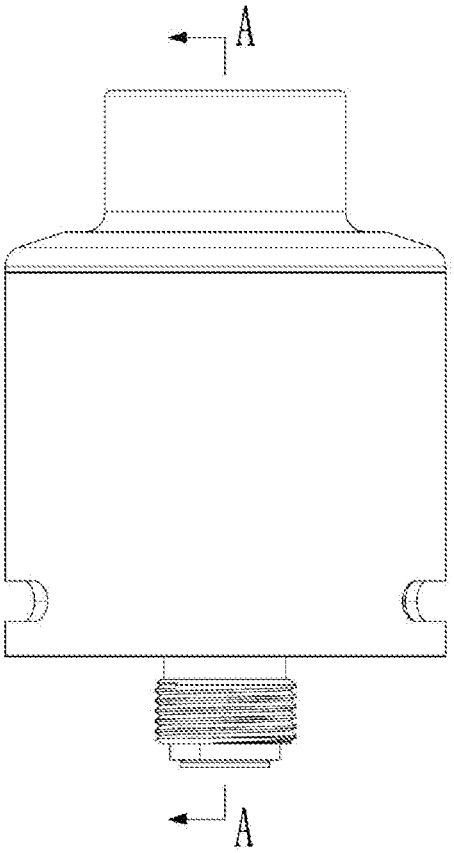
FIG. 21 is a left side view of the atomizer as shown in FIG. 20.

When the heating element 112 requires to be secured, in one heating element securing device, one leading end of the heating element 112 is placed in the first clip opening groove 382, and the first clip 38 and the second clip 39 are pressed tight, so that the dog 41 can be sliding up to the first regulating groove narrow end 3812 and a top end of the second regulating groove 391 after the first clip 38 is closed to the second clip 39. Since the width of the first regulating groove narrow end 3812 and the width of the second regulating groove 391 are equivalent to the diameter of the dog 41, after the external force is removed, under the elastic force of the fourth elastic member 40, the second regulating groove 391 and the first regulating groove 381 hold tight the dog 41 subsequent to a slight displacement, so that the dog 41 will not slip down, thereby securing the first clip 38 and the second clip 39 to prevent separation thereof. At this point, the second clip opening groove 392 and the first clip opening groove 382 hold tight one leading end of the heating element 112. Likewise, the other leading end of the heating element 112 may be placed in the other heating element securing device and the other second clip 39 to be held tight. FIG. 19 shows a state where the first clip 38 is closed to the second clip 39.

As shown in FIG. 14, in this embodiment, the atomizer includes two heating elements 112 and two liquid guiding elements 120, and both leading ends of each of the heating elements 112 are secured using the principles as described above.

As shown in FIG. 15, the atomizer also includes a positive contact 33 and a first insulating member 32. The positive contact 33 is sheathed inside the first insulating member 32, and the positive contact 33 is centrally mounted at the bottom end of the mounting base 31 together with the first insulating member 32. The positive contact 33 is electrically connected to the positive terminal.

An air intake groove 311 is provided on a side wall of the mounting base 31, and the housing 2 is correspondingly opened with a through hole, so that the outside air is in communication with the inside of the atomizer through the through hole and the air intake groove 311. The mounting seat 31 is further provided with a fitting groove 314, and a curved end 3141 extending toward the center of the mounting base 31, is provided at both ends of the fitting groove 314. After the heating element 112 is wound around the liquid guiding element 120, both ends of the liquid guiding element 120 are placed in the curved ends 3141 of the fitting groove 314 and are secured.

It will be appreciated that, in other embodiments, the first regulating groove 381 may be provided on the second clip 39, and the second regulating groove 391 is provided on the first clip 38 correspondingly.

This embodiment also provides an E-cigarette including the atomizer.

Embodiment 5

As shown in FIG. 20 to FIG. 23, an atomizer adapt for heating wires having different diameters includes a housing 2, an upper cover 21 and an atomizing assembly 1, where the upper cover 21 is capped at one end of the housing 2, and the atomizing assembly 1 is mounted in the housing 2.

The housing 2 is a hollow tubular structure penetrating through both ends, and a through hole 2-1 is opened on a side wall of the housing 2, to communicate with the outside.

At a center of an upper surface of the upper cover 21, a sucking portion 21-1 is formed by extending the upper cover 21 axially upward; and the sucking portion 21-1 has both ends penetrated, which allows the sucking portion 21-1 to be in communication with the outside and an inner cavity of the housing 2 respectively.

The atomizing assembly 1 includes a mounting base 5, a terminal, a heating element securing device and a heating element 10. In this embodiment, the heating element 10 is a heating wire. The mounting base 5 is sealed at one end of the housing 2 facing the upper cover 21, the mounting base 5 is opened with an air intake groove 5-1 corresponding to the through hole 2-1, and the inner cavity of the housing 2 is in communication with the through hole 2-1 through the air intake groove 5-1. The terminal, the heating element securing device and the heating element 10 are provided in the inner cavity of the housing 2, and the terminal is mounted on the mounting base 5. A leading end of the heating element 10 is secured to the terminal by the heating element securing device.

In this embodiment, there are two terminals, which are respectively a positive post 7 and a negative post 22. The positive post 7 has a substantially transverse "Z" shape, where an end at which the positive post 7 extends upward in the axial direction of the atomizer is a wiring end 7-1, and an end at which the positive post 7 extends downward in the axial direction of the atomizer is a conducting end 7-2. At an outer circumference of the wiring end 7-1, an external thread is provided. The atomizing assembly 1 also includes a first insulating member 3, a positive contact 4 and a second insulating member 6, where the positive contact 4 is inserted from a lower surface of the mounting base 5, and is sheathed inside the conducting end 7-2 after penetrating through an upper surface of the mounting base 5; the first insulating member 3 is provided between the mounting base 5 and the positive contact 4, such that the mounting base 5 is insulated from the positive contact 4; and the second insulating member 6 is provided between the mounting base 5 and the positive post 7, such that the mounting base 5 is insulated from the positive post 7. The negative post 22 protruding upward in the axial direction of the atomizer, is provided on the upper surface of the mounting base 5; and an external thread, is further provided at an outer circumference of the negative post 22. In this embodiment, the negative post 22 is integrally molded with the mounting base 5.

Figure 22:
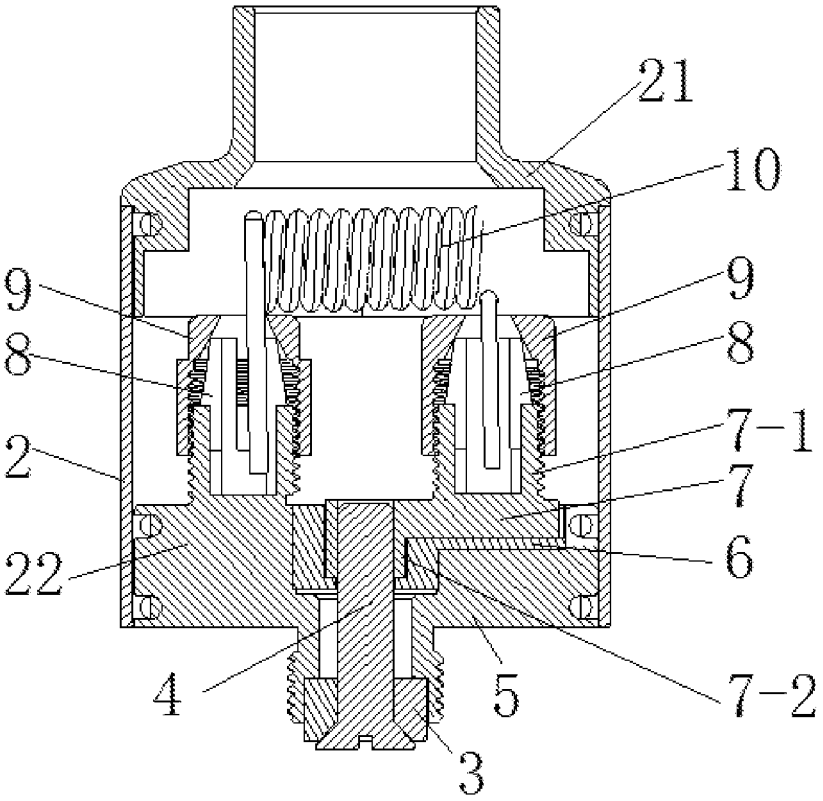
FIG. 22 is a cross-sectional view of the atomizer as shown in FIG. 21 taken along line A-A.
Figure 23:
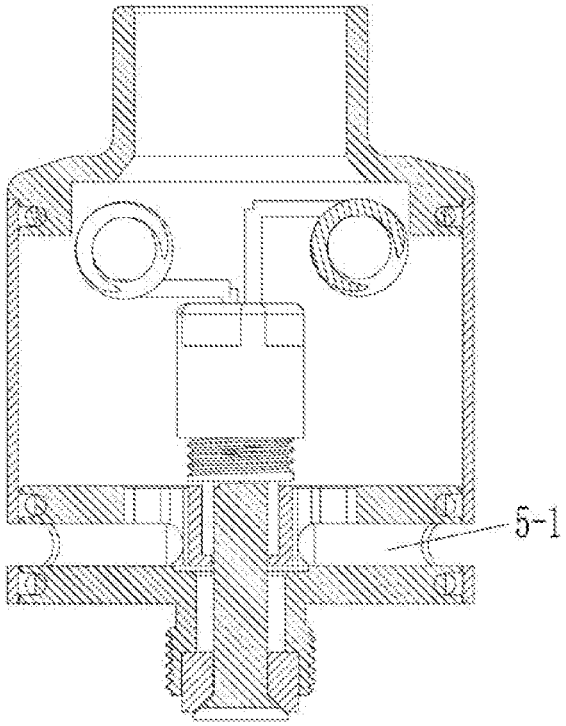
FIG. 23 is a cross-sectional view of the atomizer as shown in FIG. 21 from another perspective (the cutting direction is perpendicular to the A-A direction as shown in FIG. 22)
Figure 25:
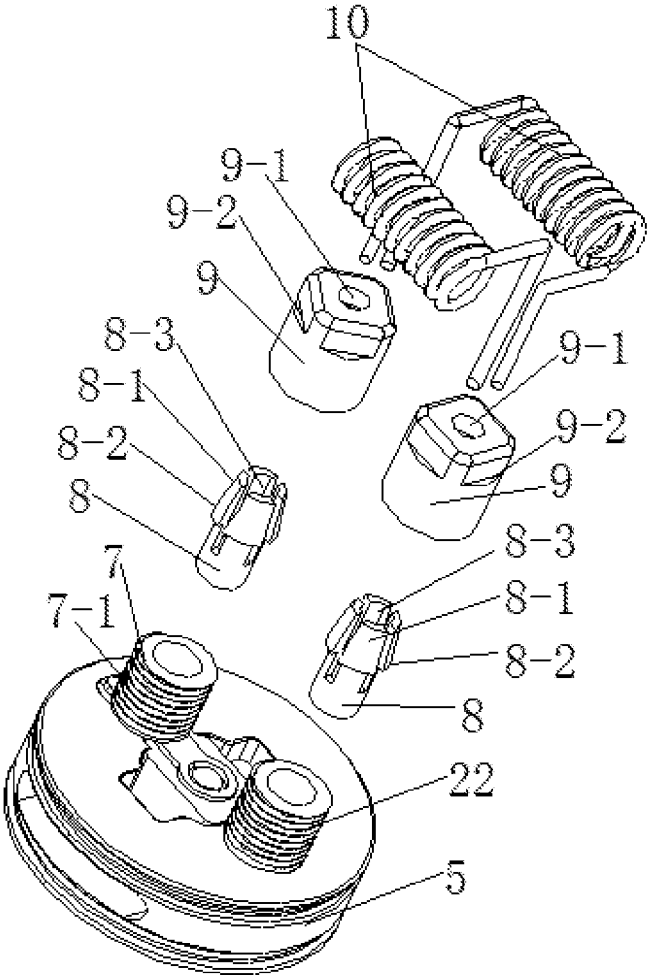
FIG. 25 is an exploded view of the atomizing assembly as shown in FIG. 24.

As shown in FIG. 22 and FIG. 25, the heating element securing device includes a securing head 8 and a sleeving 9, where one end of the securing head 8 is a wiring portion 8-2 with a tapered shape, and the other end has a cylindrical shape; the wiring portion 8-2 of the securing head 8 is internally formed with a bore 8-3 for accommodating the heating element 10; the sleeving 9 is internally provided with a tapered groove; the wiring portion 8-2 of the securing head 8 is sheathed within the tapered groove; an inner diameter at a lower end of the tapered groove is larger than an outer diameter at a lower end of the wiring portion 8-2 of the securing head 8; and an inner diameter at an upper end of the tapered groove is smaller than an outer diameter at an upper end of the wiring portion 8-2.

The sleeving 9 is provided with a channel 9-1 in communication with the bore 8-3 such that the leading end of the heating element 10 penetrates through the channel 9-1 into the bore 8-3 of the securing head 8.

The wiring portion 8-2 of the securing head 8 is tapered and, correspondingly, the tapered groove in the sleeving 9 is tapered; the cylindrical part of the securing head 8 is sheathed within the terminal; and the sleeving 9 is internally provided with an internal thread for engagement with the terminal through threads.

Figure 26:
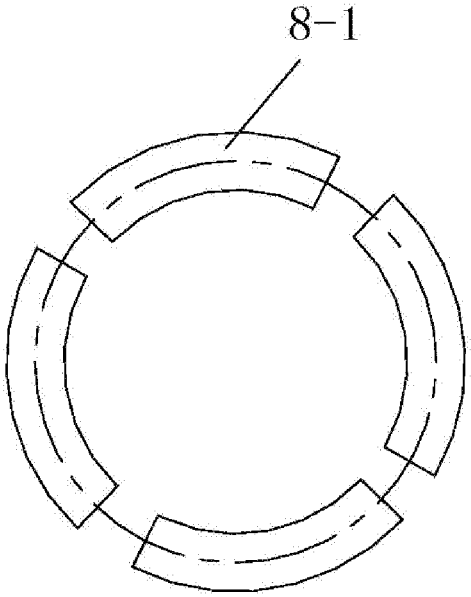
FIG. 26 is a top end view of a securing head as shown in FIG. 25.

As shown in FIG. 25 and FIG. 26, the wiring portion 8-2 is enclosed by a plurality of lamellar flaps 8-1; an inner cavity enclosed by the plurality of lamellar flaps 8-1 forms the bore 8-3 for accommodating the heating element; the plurality of lamellar flaps 8-1 is located on the same circumference; a gap is left between adjacent lamellar flaps 8-1 to achieve a better dimension adjustment of the bore 8-3, thereby accommodating heating wires having different diameters.

In one embodiment, a plurality of lamellar flaps 8-1 may be formed on the securing head 8 directly by the way of slotting.

Figure 24:
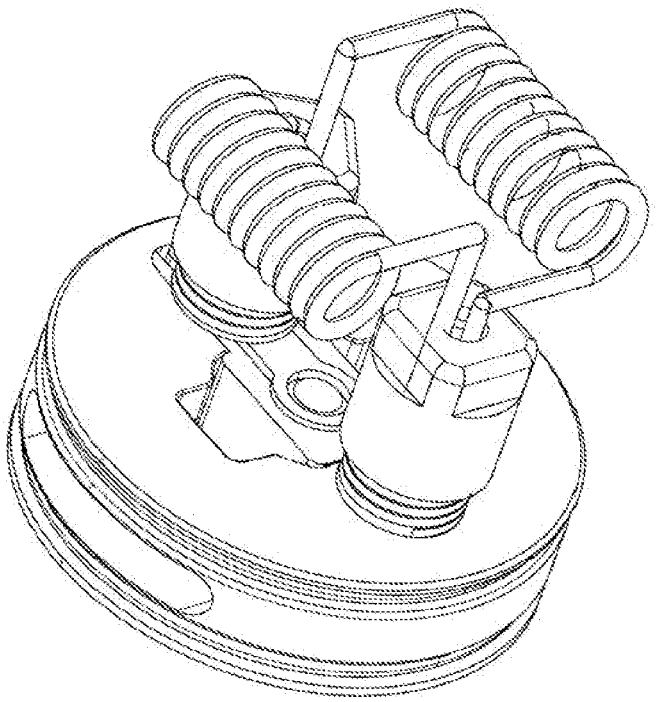
FIG. 24 is a schematic perspective view of an atomizing assembly as shown in FIG. 22.

As shown in FIG. 22, FIG. 24 and FIG. 25, in one heating element securing device, the wiring portion 8-2 is sheathed within the tapered groove inside the sleeving 9; the cylindrical part of the securing head 8 is sheathed within the wiring end 7-1 of the positive post 7; the sleeving 9 is engaged with the wiring end 7-1 of the positive post 7 through threads; and one leading end of the heating element 10 is brought into the bore 8-3 of the securing head 8 through the channel 9-1 provided in the sleeving 9. During the threading cooperation of the sleeving 9 with the positive post 7, the sleeving 9 is moved downwardly in the axial direction of the atomizer to allow the tapered groove inside the sleeving 9 to press against the lamellar flaps 8-1, and finally, the lamellar flaps 8-1 are contracted inwardly till one leading end of the heating element 10 is held tight.

Likewise, in the other heating element securing device, the wiring portion 8-2 is sheathed within the tapered groove inside the sleeving 9; the cylindrical part of the securing head 8 is sheathed within the negative post 22; the sleeving 9 is engaged with the negative post 22 through threads; and the other leading end of the heating element 10 is brought into the bore 8-3 of the securing head 8 through the channel 9-1 provided in the sleeving 9. During the threading cooperation of the sleeving 9 with the negative post 22, the sleeving 9 is moved downwardly in the axial direction of the atomizer to allow the tapered groove inside the sleeving 9 to press against the lamellar flaps 8-1, and finally, the lamellar flaps 8-1 are contracted inwardly till the other leading end of the heating element 10 is held tight.

The atomizer further includes a liquid guiding element (not shown). In this embodiment, the heating element 10 is wound around the liquid guiding element, and the liquid guiding element is cotton. In use, the upper cover 21 is opened, smoke liquid is dropped on the cotton, then the upper cover 21 is closed, and suction may be performed by electrically connecting the atomizer with a power supply device (not shown).

In this embodiment, the heating element securing device, for securing the heating wire, has the following principles:

When the heating element 10 requires to be secured, one leading end of the heating element 10 penetrates through the channel 9-1 of the sleeving 9 into the bore 8-3 of the securing head 8, and the sleeving 9 is slowly rotated such that a tapered surface of a tapered groove of the sleeving 9 is continuously pressed against a tapered surface of the wiring portion 8-2, allowing that the tapered surface of the wiring portion 8-2 to be contracted inwardly, and that the corresponding bore 8-3 is gradually decreased till one leading end of the heating element 10 is held tight completely. At this point, the sleeving 9 is in a state which it cannot be screwed downwardly, thereby the securing of one leading end of the heating element 10 is completed.

Likewise, the other leading end of the heating element 10 is also secured using the principles as described above, that is, the other leading end of the heating element 10 penetrates through the channel 9-1 of the sleeving 9 into the bore 8-3 of the securing head 8, and the sleeving 9 is slowly rotated such that a tapered surface of a tapered groove of the sleeving 9 is continuously pressed against a tapered surface of the wiring portion 8-2, allowing that the tapered surface of the wiring portion 8-2 to be contracted inwardly, and that the corresponding bore 8-3 is gradually decreased till the other leading end of the heating element 10 is held tight completely. At this point, the sleeving 9 is in a state which it cannot be screwed downwardly, thereby the securing of the other leading end of the heating element 10 is completed.

As shown in FIG. 25, this embodiment can realize simultaneous securing of two heating wires by using the above-described principles.

Figure 27:
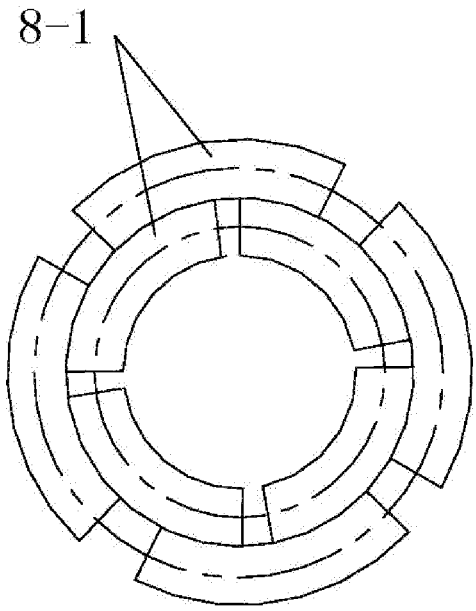
FIG. 27 is another top end view of the securing head as shown in FIG. 26.

In one embodiment, as shown in FIG. 27, a manner in which a plurality of lamellar flaps 8-1 of the wiring portion 8-2 is enclosed may user a manner in which adjacent lamellar flaps 8-1 are staggered and overlapped, that is, the plurality of lamellar flaps 8-1 are located on two circumferences, a gap is left between adjacent lamellar flaps 8-1 on each circumference, lamellar flaps 8-1 on one circumference are staggered and overlapped with lamellar flaps 8-1 on the other circumference.

In one embodiment, the sleeving 9 is externally provided with an anti-slip groove 9-2, to prevent that a phenomenon of slipping occurs when the sleeving 9 is screwed with the wiring end 7-1 of the positive post 7 or the negative post 22.

Embodiment 5 also provides an E-cigarette (not shown) including the atomizer described above.

Embodiment 6

Embodiment 6 differs from Embodiment 5 in that: the sleeving 9 in Embodiment 6 uses an annular ring configuration, at a lower end of the annular ring configuration, an inner diameter is larger than an outer diameter at a lower end of the wiring portion 8-2 of the securing head 8, while at an upper end of the annular ring configuration, an inner diameter is smaller than an outer diameter at an upper end of the wiring portion 8-2. It will be appreciated that, an opening of the annular ring may be used for a leading end of the heating element 10 to penetrate through it, and then extend into the bore 8-3. Therefore, it is unnecessary to provide an additional channel for the annular ring.

When the heating element 10 requires to be held tight, one leading end of the heating element 10 is placed in the bore 8-3 of the securing head 8, the annular ring is gradually sliding toward a lower end of the wiring portion 8-2, causing that a tapered surface of the wiring portion 8-2 is contracted inwardly, and that the corresponding bore 8-3 is gradually decreased till one leading end of the heating element 10 is held tight completely. Likewise, the other leading end of the heating element 10 is secured by using the same principles.

Embodiment 6 also provides an E-cigarette (not shown) including the atomizer described above.

According to this embodiment, it is possible to achieve securing of heating wires having different diameters, and it is also possible to achieve simultaneous securing of a plurality of the heating wires, thus the securing is reliable and the operation is simple. A user is allowed to use heating wires having different diameters on the same liquid-dripping atomizer, thereby obtaining better experience.

The described embodiments are merely preferred embodiments for sufficiently explaining the present invention, but the scope of the present invention is not limited thereto. Any equivalent substitution or variation made by those skilled in the art on the basis of the present invention should fall into the scope of the present invention. The scope of the invention is subject to the claims.

What is claimed is:

1. An atomizer, comprising an atomizing assembly, wherein the atomizing assembly comprises a heating element and a terminal connected to the heating element, and characterized in that:

the atomizing assembly further comprises a heating element securing device, the heating element is secured to the terminal by the heating element securing device, the heating element securing device comprises a holding portion which is movably provided on the terminal, a movement of the holding portion enables the holding portion to be separated from or closed to the terminal, and when the holding portion is closed to the terminal, the heating element is held between the holding portion and the terminal.

2. The atomizer according to claim 1, wherein the heating element securing device further comprises a first elastic member, one end of the first elastic member provides an elastic resistance to aside of the holding portion away from the terminal, and the first elastic member makes the holding portion tend to be in a closure status with the terminal.

3. The atomizer according to claim 2, wherein the heating element securing device further comprises a guiding post, one end of the guiding post is securely connected to the terminal, the other end of the guiding post is provided with a restricting portion, the holding portion is sheathed on the guiding post and is slidable in an axial direction of the guiding post, and the other end of the first elastic member provides an elastic resistance to the restricting portion.

4. The atomizer according to claim 3, wherein the holding portion comprises a mounting portion extending in the axial direction of the atomizer and a crimping portion provided at one end of the mounting portion and perpendicular to the mounting portion; and a guiding groove is opened in the axial direction of the holding portion, and penetrates through the mounting portion and the crimping portion; one end of the guiding post opposite to the restricting portion penetrates through the guiding groove and is securely connected to the terminal; the side of the holding portion away from the terminal is a groove bottom wall of the guiding groove; the terminal is provided with a groove; and when the holding portion is closed to the terminal, the mounting portion is accommodated in the groove, and the crimping portion is in close contact with the terminal.

5. The atomizer according to claim 1, wherein the heating element securing device further comprises a third elastic member, the holding portion is rotatably provided on the terminal, the third elastic member provides an elastic resistance to the terminal and the holding portion at both ends, and the third elastic member makes the holding portion tend to be in a closure status with the terminal.

6. The atomizer according to claim 1, wherein the heating element securing device further comprises a fourth elastic member and a dog, the holding portion is rotatably provided on the terminal, the fourth elastic member provides an elastic resistance to the terminal and the holding portion at both ends, and the fourth elastic member makes the holding portion tend to be in a separation status with the terminal, and when the heating element is held between the holding portion and the terminal, the dog is used to secure the holding portion and the terminal.

7. The atomizer according to claim 6, wherein the terminal has a side plate which is overlapped with that of the holding portion, a first regulating groove is provided on the side plate of the holding portion, wherein the first regulating groove comprises a first regulating groove wide end near a joint of the holding portion and the terminal and a first regulating groove narrow end away from the joint of the holding portion and the terminal, and the first regulating groove wide end is in communication with the first regulating groove narrow end; a second regulating groove corresponding to the first regulating groove is provided on the side plate of the terminal, and when the dog is provided at the first regulating groove wide end and a bottom end of the second regulating groove, the holding portion is separated from the terminal, and when the holding portion is rotated till the first regulating groove narrow end is aligned with a top end of the second regulating groove and the dog is provided at the first regulating groove narrow end and the top end of the second regulating groove, the holding portion is closed to the terminal.

8. The atomizer according to claim 1, wherein the atomizer further comprises a liquid guiding element, the atomizing assembly further comprises a base and a rotary retainer ring mounted on the base, the base is provided with a securing groove, the rotary retainer ring is provided with a baffle for covering/opening the securing groove, an end of the liquid guiding element is inserted into the securing groove, and the end of the liquid guiding element is secured between a side wall of the baffle and a corresponding groove wall of the securing groove by rotating the rotary retainer ring.

9. The atomizer according to claim 8, wherein the atomizer further comprises a second elastic member, the baffle is provided with a block at one side, a lower end of the block is inserted into the securing groove, an upper end of the block protrudes beyond an upper end of the rotary retainer ring, one end of the second elastic member provides an elastic resistance to the lower end of the block, and the other end of the second elastic member provides an elastic resistance to a groove wall of the securing groove facing the block.

10. An E-cigarette, comprising an atomizer, wherein the atomizer comprises an atomizing assembly, the atomizing assembly comprises a heating element and a terminal connected to the heating element, the atomizing assembly further comprises a heating element securing device, the heating element is secured to the terminal by the heating element securing device, the heating element securing device comprises a holding portion which is movably provided on the terminal, a movement of the holding portion enables the holding portion to be separated from or closed to the terminal, and when the holding portion is closed to the terminal, the heating element is held between the holding portion and the terminal.

11. The E-cigarette according to claim 10, wherein the heating element securing device further comprises a first elastic member, one end of which provides an elastic resistance to a side of the holding portion away from the terminal, and the first elastic member makes the holding portion tend to be in a closure status with the terminal.

12. The E-cigarette according to claim 11, wherein the heating element securing device further comprises a guiding post, one end of the guiding post is securely connected to the terminal, the other end of the guiding post is provided with a restricting portion, the holding portion is sheathed on the guiding post and is slidable in an axial direction of the guiding post, and the other end of the first elastic member provides an elastic resistance to the restricting portion.

13. The E-cigarette according to claim 10, wherein the heating element securing device further comprises a third elastic member, the holding portion is rotatably provided on the terminal, the third elastic member provides an elastic resistance to the terminal and the holding portion at both ends, and the third elastic member makes the holding portion tend to be in a closure status with the terminal.

14. The E-cigarette according to claim 10, wherein the heating element securing device further comprises a fourth elastic member and a dog, the holding portion is rotatably provided on the terminal, the fourth elastic member provides an elastic resistance to the terminal and the holding portion at both ends, and the fourth elastic member makes the holding portion tend to be in a separation status with the terminal, and when the heating element is held between the holding portion and the terminal, the dog is used to secure the holding portion and the terminal.

15. The E-cigarette according to claim 14, wherein the terminal has a side plate which is overlapped with that of the holding portion, a first regulating groove is provided on the side plate of the holding portion, wherein the first regulating groove comprises a first regulating groove wide end near a joint of the holding portion and the terminal and a first regulating groove narrow end away from the joint of the holding portion and the terminal, and the first regulating groove wide end is in communication with the first regulating groove narrow end; a second regulating groove corresponding to the first regulating groove is provided on the side plate of the terminal, and when the dog is provided at the first regulating groove wide end and a bottom end of the second regulating groove, the holding portion is separated from the terminal, and when the holding portion is rotated till the first regulating groove narrow end is aligned with a top end of the second regulating groove and the dog is provided at the first regulating groove narrow end and the top end of the second regulating groove, the holding portion is closed to the terminal.

16. The E-cigarette according to claim 10, wherein the atomizer further comprises a liquid guiding element, the atomizing assembly further comprises a base and a rotary retainer ring mounted on the base, the base is provided with a securing groove, the rotary retainer ring is provided with a baffle for covering/opening the securing groove, an end of the liquid guiding element is inserted into the securing groove, and the end of the liquid guiding element is secured between a side wall of the baffle and a corresponding groove wall of the securing groove by rotating the rotary retainer ring.

17. The E-cigarette according to claim 16, wherein the atomizer further comprises a second elastic member, the baffle is provided with a block at one side, a lower end of the block is inserted into the securing groove, an upper end of the block protrudes beyond an upper end of the rotary retainer ring, one end of the second elastic member provides an elastic resistance to the lower end of the block, and the other end of the second elastic member provides an elastic resistance to a groove wall of the securing groove facing the block.

18. An atomizer comprising an atomizing assembly, wherein the atomizing assembly comprises a heating wire and a terminal connected to the heating wire, and characterized in that:

the atomizing assembly further comprises a heating element securing device, the heating wire is secured to the terminal by the heating element securing device, the heating element securing device comprises a sleeving and a securing head with a lower end connected to the terminal, a bore for accommodating the heating wire is formed inside the securing head, an upper end of the securing head is a wiring portion, an inner diameter at a lower end of the sleeving is larger than an outer diameter at a lower end of the wiring portion, an inner diameter at an upper end of the sleeving is smaller than an outer diameter at an upper end of the wiring portion, when the sleeving is sheathed on an outer circumference of the securing head, and the upper end of the sleeving is pressed against the upper end of the wiring portion, such that the upper end of the wiring portion holds tightly the heating wire.

19. The atomizer according to claim 18, wherein the sleeving is internally provided with a tapered groove, the wiring portion is tapered and is sheathed inside the tapered groove, an inner diameter at a lower end of the tapered groove is larger than the outer diameter at the lower end of the wiring portion, and an inner diameter at an upper end of the tapered groove is smaller than the outer diameter at the upper end of the wiring portion.

20. The atomizer according to claim 18, wherein an external thread is provided at an outer circumference of the terminal, the sleeving is internally provided with an internal thread, and the sleeving is threadedly connected to the terminal after being sheathed on the outer circumference of the securing head.

* * * * *